US011944246B1

(12) United States Patent
Fulbrook

(10) Patent No.: US 11,944,246 B1
(45) Date of Patent: Apr. 2, 2024

(54) TOTAL-USE DISPENSER

(71) Applicant: Jim E. Fulbrook, Fairfax, VA (US)

(72) Inventor: Jim E. Fulbrook, Fairfax, VA (US)

(73) Assignee: Efficiency Products, LLC, Fairfax, VA (US)

( * ) Notice: Subject to any disclaimer, the term of this patent is extended or adjusted under 35 U.S.C. 154(b) by 0 days.

(21) Appl. No.: 18/129,889

(22) Filed: Apr. 2, 2023

Related U.S. Application Data

(63) Continuation of application No. 17/723,993, filed on Apr. 19, 2022, now Pat. No. 11,617,477.

(60) Provisional application No. 63/176,810, filed on Apr. 19, 2021.

(51) Int. Cl.
*A47K 5/12* (2006.01)
*A45D 34/00* (2006.01)

(52) U.S. Cl.
CPC ..... *A47K 5/1211* (2013.01); *A45D 34/00* (2013.01); *A45D 2200/055* (2013.01); *A47K 2005/1218* (2013.01)

(58) Field of Classification Search
CPC ..... A47K 5/1211; A47K 2005/1218; A45D 34/00; A45D 2200/055
See application file for complete search history.

(56) References Cited

U.S. PATENT DOCUMENTS 1,783,419 A 12/1930 Fitch
4,470,526 A 9/1984 Cha et al.
4,646,944 A * 3/1987 Sanderson ..... B67D 3/00 222/108
4,848,599 A * 7/1989 Kano ..... A47K 5/1211 222/402
5,366,119 A 11/1994 Kline
6,257,446 B1 7/2001 Pike
6,752,297 B1 6/2004 Ische
8,038,040 B2 10/2011 Dennis
8,365,941 B2 2/2013 Mayer
8,523,005 B2 9/2013 Martin et al.
8,608,033 B2 12/2013 Hoefing et al.
9,783,339 B1 10/2017 Atkinson et al.
10,464,713 B2 11/2019 Campbell
2001/0030203 A1 10/2001 Weber
2001/0032864 A1 10/2001 Sheperd
2005/0155990 A1 7/2005 Gardiner
2008/0302831 A1 * 12/2008 Wang ..... B65D 1/06 222/321.5
2013/0026125 A1 1/2013 Letchinger et al.

* cited by examiner

*Primary Examiner* — Donnell A Long
(74) *Attorney, Agent, or Firm* — Invention To Patent Services; Alex Hobson

(57) ABSTRACT

A total-use dispenser for dispensing a fluid product therefrom. A total-use dispenser may have a body forming an enclosure having both a top opening and a bottom outlet and a tapering portion that tapers down toward the bottom outlet and a pump configured in the top opening to dispense the fluid product from the dispenser. The pump may be configured in the top opening to pump air into the rigid body to force fluid product therefrom. The fluid product may be dispensed from a bottom outlet or from a spout coupled with a spout conduit that extends into the squeezable body of the total-use dispenser. The total-use dispenser enables substantially all the fluid product to be dispensed from the enclosure, such as at least 90% by weight, at least 97% by weight and most preferably 99% or more by weight.

15 Claims, 8 Drawing Sheets

TOTAL-USE DISPENSER

CROSS REFERENCE TO RELATED APPLICATIONS

This application is a continuation of U.S. patent application Ser. No. 17/723,993, filed on Apr. 19, 2022 and currently pending, which claims the benefit of priority to U.S. provisional patent application No. 63/176,810, filed on Apr. 19, 2021; the entirety of each prior application is hereby incorporated by reference herein.

BACKGROUND OF THE INVENTION

Field of the Invention

The invention relates to a variety of bottle designs having a top and bottom opening with either a pump or one-way valve coupled to the top opening to enable substantially all of the contents of the bottle to be dispensed therefrom by the pump action or from squeezing the bottle by the user.

Background

Bottles for dispensing household fluid products, such as lotions, soap, hair products, face creams and the like, often have a single top opening making it difficult to dispense the product as the content of the product within the bottle is diminished. In some cases, the bottles are turned over and when the viscosity of the product is high it may take a considerable amount of time to dispense the product. Some bottles utilize a pump with a fluid conduit extending down into the bottle and the shape of the bottle prevents a substantial amount of the product from being dispensed. Many of these products, especially face creams and hair products can be expensive and wasting the product due to difficulty removing or dispensing the product from the bottle costs the consumer money.

There are many bottles in the prior art and market that generally are comprised of any number of common features that include shape, rigidity, opacity, a pump or are squeezable without a pump, a dispenser such as a spout, sprayer, or diaphragm, a tube if the dispenser is at the top of the bottle, and a lid or cap that attaches to the top or bottom of the bottle. A high majority of bottles in the prior art do not address features that are directed to total-use of the content.

SUMMARY OF THE INVENTION

The invention is directed to a total-use dispenser for dispensing a fluid product therefrom. An exemplary total-use dispenser has a body forming an enclosure having both a top opening and a bottom outlet and a tapering portion that tapers down toward the bottom outlet. An exemplary total-use dispenser utilizes a pump coupled with the top opening to dispense the fluid product from the dispenser. An exemplary total-use dispenser has a pump configured in the top opening that pumps air into the body to force fluid product therefrom. The pump may be a diaphragm pump or pump with a stem and handle that are moved into and out of the body of the total-use dispenser. The fluid product may be dispensed from a bottom outlet or from a spout coupled with a spout conduit that extends into the body of the total-use dispenser. The total-use dispenser enables substantially all the fluid product to be dispensed from the enclosure, such as at least 90% by weight, at least 97% by weight and most preferably 99% or more by weight.

An exemplary body of has a shape to enable efficient dispensing of fluid-product from the enclosure. An exemplary body has a top opening and a bottom outlet and a tapering portion that tapers to the bottom outlet. An outlet extension may extend from or be part of the tapering portion and may extend outward from beneath the retainer portion of the body to allow easy dispensing when configured in a stand. The bottom outlet may be configured an offset distance from the body.

The retainer portion may be configured between the tapering portion and the top opening and may be uniform in cross section and may be circular or oval in cross section. The body may have a grip portion configured proximal to the top opening to enable the body to be held while interfacing with a pump in the top closure. An exemplary grip portion may have a plurality of indentations that may be configured to couple with a person's fingers. The body may have an hourglass shape with a smaller portion configured between larger portions above and below. The body may have an upper portion and a lower portion and the lower portion may be smaller in cross-sectional size or diameter than the upper portion.

In all cases, the body tapers toward the bottom outlet to direct the fluid product to flow to the bottom outlet. A product cup may be coupled to the body over the bottom outlet and may be detachably attachable to the body. The product cup may have threads that enable the product cup to be threaded over the bottom outlet. The product cup may be removed to utilize a small remaining amount of fluid product collected therein.

A diaphragm may be configured over the bottom outlet to control the release of fluid product through the bottom outlet. The diaphragm may be coupled with the body or the product cup. The product cup may have a bottom cap that can be opened to allow fluid product to be dispensed through the bottom outlet and the product cup. The bottom cap is hinged and may be closed over the bottom outlet to seal the fluid product from release through the bottom outlet. The bottom cap may be detachably attachable to the product cup or may be attached by a hinge to allow the fluid to be dispensed through the product cup.

Fluid product may be dispensed through a spout that has a spout conduit that extends down to close proximity with the bottom outlet. The spout may have a stopcock to open and close so fluid product flows through the spout. The spout may be pivotable about the stopcock to open and close the stopcock. The spout may extend out from the body, such as from the side, or from the top closure. The spout may extend out from the side of the body in an upper portion, or portion that is above a midpoint of the height of the body, or from a lower portion, or a portion that is below a midpoint of the height of the body. The spout conduit may extend along the inside or outside surface of the body down toward the bottom outlet and may extend into the product cup or bottom cap.

The bottom outlet or product cup may have an angled fluid deflector that extends from an upper side to a lower side to direct fluid product down toward the lower side. The deflector may be angled or have a curved surface from an elevated position down to a lower position where the diaphragm is located. The bottom outlet may be configured on the lower side to ensure almost all of the fluid product may be dispensed from the total-use dispenser. The spout conduit inlet may be configured just over the lower side of the angled fluid deflector to allow almost all of the fluid product to be forced into the spout conduit and dispensed through the spout.

A spout may have a rotatable spout valve, wherein in one rotational orientation, the spout is closed and wherein in a second rotational orientation the fluid is dispensed from the spout, such as by flow and/or spray. There may be two or more dispensing options, such as flow and spray. A user may want to spray the fluid over a larger area or just have it flow out in a stream.

The body may be rigid and be made of rigid material, such as glass, or hard plastic that is not easily deformable by hand. Alternatively, the body may be formed from a deformable material, such as deformable plastic to allow product to be squeezed from the total-use dispenser. The total-use dispenser may be squeezed to force fluid product through the bottom outlet or a spout. A squeeze bottle, as used herein, is a bottle that is deformable and resilient to allow the bottle to be squeezed by hand and deformed, thereby producing an increased pressure in the bottle to dispense the contents within the bottle. A diaphragm or a pump air conduit may be configured to allow air to enter into the body after fluid product is dispensed, in order to equalize the pressure within the body. As described herein a diaphragm may be configured over the top opening or bottom outlet. The diaphragm or pump-air conduit may be coupled with the top closure. A diaphragm may be configured over the bottom outlet or coupled with the product cup or bottom cap. A diaphragm in the bottom outlet may control the release of fluid product through the bottom outlet. A diaphragm in the bottom outlet may have one or more slits in an elastomeric material to allow the diaphragm to open for fluid product dispensing therethrough.

The body may be translucent or transparent to enable a user to see the level of fluid product within the enclosure. A head space may be formed between the fluid and the top opening within the enclosure. A body may have a grip portion configured proximal to the top of the body having a plurality of indentations, such as grooves, extending around at least a portion of the body, or neck of the body. The grooves may be configured to allow fingers to rest therein to ensure a firm grip on the body.

An exemplary total-use dispenser utilizes a pump for dispensing fluid product from the enclosure. A pump may include a diaphragm that allows air to enter into the enclosure. A pump may be used in combination with a deformable body that is a squeeze body, a body that can be squeezed to increase a head pressure over the fluid product within the enclosure. A diaphragm may enable air to enter into the enclosure to allow the squeezed body to return to an original shape. In another embodiment, a diaphragm pump is configured with a diaphragm that is configured for a user to press and deform to force air into the enclosure to increase a head pressure and force fluid product from the bottom outlet. A diaphragm pump may be configured in a top closure or cap and may be detachable from the body.

An exemplary pump may include a stem and pump handle. An insert end of the stem may extend into the enclosure and the exposed portion of the stem may extend to the pump handle. A pump handle may be pressed into the body to force air into the enclosure to increase the head pressure and force fluid product from the enclosure. In an exemplary embodiment, a pump stem may extend at a stem offset angle to make more ergonomic use of the pump when grasping the top of the body, such as when grasping the grip portion around a neck of the body. The stem offset angle from a vertical axis or longitudinal axis of the total-use dispenser body may be about 10 degrees or more, about 15 degrees or more, about 25 degrees or more, about 35 degrees or more, about 45 degrees or less or any range between and including the offset angle provided. A pump may have a fluid conduit that extends down into the enclosure to a fluid conduit inlet. The inlet may be configured proximal to the bottom outlet cover and may have a gap distance there between that is small, such as less than about 10 mm, less than about 7 mm, less than about 5 mm, less than about 3 mm and any range between and including the values provided.

The total-use dispenser may have a plurality of legs to support the body in an upright configuration. The legs may be three or more and may be coupled with a detachable stand. The detachable stand may have an opening for receiving the body of the total-use dispenser.

A method of use includes removing the total-use dispenser from a detachable stand and then squeezing the body to dispense fluid product from the bottom outlet. A bottom cap may have to be opened first to enable the fluid product to flow through the bottom outlet. Also, the fluid product may be dispensed through a spout when the body is squeezed. Alternatively, a pump may be pumped to dispense fluid product through the bottom outlet or a spout. Finally, a dispenser pump configured in the top opening may be utilized to dispense fluid product through the pump outlet. The dispenser pump may be used with the total-use dispenser configured in the detachable stand. Again, the pump stem of the dispenser pump may be angled to provide more ergonomic use while holding the total-use dispenser. Likewise, fluid product may be dispensed through the bottom outlet or a spout when the body is squeezed or when a diaphragm is actuated, again when the total-use dispenser is in or out of the detached or attached stand.

The pump of the present invention may be an inline piston air pump that includes a piston, piston rod, cylinder, a spring, and/or one-way air valves. A top stem of the pump is configured to be depressed by a user forcing air into the container body above the fluid product to increase the pressure in the head space above the fluid product. This increased pressure causes the product to be dispensed at an outlet due to the increased pressure. The pump stem has a spring that returns the stem to its top traverse position while air valves balance the internal air pressure and refill the pump for the next time it is depressed. The use of a pump occurs with rigid containers; whereas the deformable container body dispenses fluid product by the user squeezing the bottle, after which a one-way air valve at the top of the container allows air to refill the container by equalizing the air pressure within so that the body may return to its standing or resting shape.

The present novel invention relates to a unique combination of bottle features that derive unique methods of use that allow the content to be totally dispensed by one or more methods in the same bottle. The combination of invention features creates a system that is more than the sum of its parts because these features in each embodiment are necessary to achieve a bottle that allows for the total-use of the content. If these features were readily surmisable by someone skilled in the art, then the embodiments and combination of features in the art would have been patented long before this invention. In this novel invention, the discriminating differences include openings at the top and bottom of the bottle, smooth sides down to the bottom opening or lowest spout, threads to screw on a cap or lid that are on the outside of the bottle so the inside portion is smooth, a novel design of the cap that includes a concave or offset concave diaphragm, a novel design of the tube going from the bottom of the bottle at the diaphragm up to the capped spout or sprayer that is flush and smooth on the inside of the bottle, and the novel use of an air pump and air valves as a means to dispense contents as described herein. To clarify the differences, background on the air pump followed by the novel bottle features and dispensing methods follows.

The industry standard for bottles with pumps in the prior art and market is called a "Reciprocating Positive Displacement Piston Pump." This fluid pump uses a single valve and a piston to create less pressure to "draw" or suck fluid into a chamber. The piston dispenses the fluid when a user presses down on a finger pump or squeezes a spray trigger located on the top of the bottle. After the downward finger press, a spring causes the presser back to the up position, which creates negative pressure in the chamber that draws fluid into the piston so the bottle is primed to dispense the fluid content when the finger pump is pressed or trigger pulled the next time.

The pump described herein, and intended for use in the rigid bottle embodiments, is a "Reciprocating Inline Piston Air Pump." This air pump has an inline cylinder and piston and uses two or more opposing one-way valves. It is the same type of pump used in a standard tire or sports ball pump with one notable difference: it requires a spring to return the pump piston to the top, where air refills the cylinder. In this application, the general use of the term "pump" then refers to the reciprocating inline piston air pump unless noted otherwise.

When a user of the air pump presses down on the novel curved finger pump, the valve on the piston closes to prevent a loss of pressure. The air flows into the bottle and increases pressure inside, which pushes or dispenses fluid out through the selected spout or diaphragm. At the end of the piston stroke, as the spring returns the finger pump to the up position, the opposing valve opens to allow air to refill the cylinder chamber for the next pump action.

The two pump systems each have advantages and disadvantages between them. Fluid pumps work best when there is continuous fluid without air or bubbles in the fluid. A drawback, however, is reduced performance due to negative pressure. In a closed system, the bottle cannot equalize the pressure inside as fluid is dispensed, which creates negative pressure, causing the bottle walls to collapse inward in a flexible bottle and the fluid pump to become less effective. When this happens, users may encounter a shortening of the pump stroke length, or a collapsed bottle where the user must open the container to equalize the pressure. In a bottle with an air pump, the internal air pressure in the bottle equalizes automatically when the content is dispensed. By using a rigid bottle material, such as glass, the gradual release of the compressed air as the fluid is dispensed works as well as the fluid pump since the bottle and fluid contents are not compressible. The air pump has a limitation in that it does not function well with non-rigid, flexible bottles, but a flexible bottle is typically squeezed to dispense contents without the use of a pump of any type.

The curved inline air pump of this invention has four advantages: 1) Increased reliability due to the pump's separation from the dispensing lines such as a tube and spout; 2) An ergonomic thumb pump and curved plunger, which improves pump efficiency and user comfort; 3) A simple design, which may reduce production costs; and 4) The versatility to accommodate non-obvious, unique combinations of dispensing components (spouts, tubes, diaphragms, etc.) used at the tops and bottoms of bottles. In summary, the air pump allows for a number of embodiments tailored to specific methods and applications of use as described herein.

Aside from the pump type when used, the bottles in this application have many features in common that may be combined as necessary and sufficient components to define each bottle embodiment and its method(s) of use so that as the bottle is emptied, the content is totally dispensed. One way to define total-use dispensing is a subjective assessment by the user that the amount of content remaining in the bottle is less than a useful portion or too small in fluid volume to be considered worth trying to extract. The notion of total-use is objectively and technically defined later in the application based on percentage of content weight.

The novel combinations of features for the embodiments described and their methods of dispensing include but are not limited to the air pump, use of a one-way gravity-closed pressure equalization valve (i.e., a vent with a flap cover), novel bottle shapes and smooth inside surfaces, the use of a tube that is part of the bottle mold itself, the use of more than one lid and cap at the top and bottom of the bottle, the novel design of the diaphragm, and the types of legs or base used for the bottle that facilitate total-use of the contents by the dispensing method. A person skilled in the arts should recognize that the novel combinations of component features yield a total-use of the contents unlike any other prior art or market bottle by embodiment design and method of use by both objectively defined and subjective assessments of total-use dispensing of the content. The rest of the background describes the specific components or functional features that combine to produce novel total-use bottle embodiments.

There are two types of bottles: a rigid bottle that requires an air pump and a flexible bottle that dispenses by physically squeezing the bottle. There are three primary apparatuses or means from which fluids are dispensed out of a bottle: By a cap and lid usually with a diaphragm at the bottom of a bottle, by a spout that produces a continuous flow coming out from the lower portion of the bottle, or by a spout or sprayer located halfway or higher up on the bottle in which case a tube coming from the bottom to the spout is required. There is not an embodiment in this application where the bottle must be turned over in order to wait for the fluid content to flow to the inverted top lid to be dispensed through an opening. This method of dispensing is very common in many bottles in the prior art and commercial market.

There are three means by which a user holds a bottle in order to dispense fluid: By a hand grip at the top of the bottle to conveniently press a pump with a curved shaft, in the middle of the bottle where the user squeezes it, and from the lower section of the bottle also for squeezing to dispense the content. The hand grip areas at the top, middle, or lower portions of the bottles confer certain shapes and diameters that facilitate the function of gripping the bottle with one hand to either press the pump or squeeze the bottle for tailored uses. In the three instances, the bottle diameter must be small enough so that the bottle can be easily gripped to press the pump plunger or to squeeze the bottle as the dispensing means.

Bottles may be designed from top to bottom with smooth inner surfaces without any kind of ridges or shapes where the fluid contents may be retained against the inside wall. Bottles may gradually angle down and in toward the bottom (lowest part) of the bottle so fluid flow is facilitated. Bottles may have bottoms that gradually curve down toward a lower spout such that the end of the spout is the lowest part of the bottle. The other more common design is a gradual taper down to the bottom cap and diaphragm area. The bottom of the bottle with a cap and lid may have the threads on the outside surface so that the inside of the bottle is smooth. Hence, the cap and lid screw onto the outside, but the bottle itself is unique with this thread design and bottom configuration of the cap, its lid, and the tapered diaphragm as part of the cap and lid.

In order for the user to be aware of the amount of fluid remaining in the bottle, the bottles may be clear, nearly clear (low opacity) or if some of the bottle is opaque, then a sizable portion of it must be clear enough so that the user can readily view the amount of fluid content remaining down to the bottom. The preferred design is a clear bottle where the manufacturer of the fluid content affixes labels onto the bottle but leaves an area exposed to see the content level to the bottom. This is an important condition to gauge level and observe that contents are totally used as operationally defined.

The top will have either a novel curved thumb pump or a simple air valve or breather vent with a flap design where any action to dispense will keep the vent closed, but when the pressure is released, the vent flap opens and air flows through to equalize the pressure inside the bottle with the outside. All tops may be detachably attachable so they can be removed by the user for cleaning for recycling or reuse. The top opening may be used for refilling when the bottle can be reused with the same product (such as kitchen hand soap). The top of the bottles may have the threads on the outside of the bottle so that the inside within the bottle is smooth similar to the bottom opening.

The bottom dispenser may be composed of a cap, lid, threaded attachment, and a diaphragm. As stated, the inside of the bottle at the threads and circular opening may be smooth. The diaphragm may be part of the cap and lid and tight fits with the inside bottle. There are three diaphragm options: A centered concave diaphragm that tight fits with the inside of the bottle, an offset concave diaphragm at the lowest point of a curved or tapered bottom where the diaphragm is positioned directly under a tube when an upper spout is used, or no diaphragm may be used if the fluid is thick enough and the opening properly sized.

The bottles may have three, four, or five legs. The legs may be either a permanent part of the manufactured bottle or detachably attachable legs may be used that attach onto the bottle. If a spout is used and three legs are used, then one of the legs must be on the direct opposite side of the spout. If four legs are used with a spout, the spout must be between one of the leg pairs below it so that the legs do not interfere with the dispensing process. The bottom lid and cap may be on the same plane as the bottom feet of the legs so that the cap rests on the surface to provide added support and to confirm the cap is properly closed so no leakage occurs. In short, this feature has two functional benefits.

The intent for bottles with detachably attachable legs is to create decorative and artful designs so the bottles have an aesthetic quality to them. There is also an economic advantage to having detachably attachable legs because consumers can purchase replacement bottles and reuse the decorative legs or change the decorative style of the bottle as desired. The detachably attachable decorative legs may extend over the bottle and attach under the screw-on top cap as an alternative means to attach and secure the legs.

When a spout or spray dispenser is used from the middle to the top of the bottle, a tube is required. The tube may be part of a two-piece injection mold where the two sides are joined to create a closed tube. The key feature of the tube is that it may be flush with the inside of the bottle so there are no grooves where the content might collect. This may be accomplished by the tube being on the outside of the bottle or if the tube is inside the bottle to some degree, the outside surface may have a normal distribution curve shape along its length so there are no grooves in this configuration as well. Tube diameter may be determined by the viscosity of the content to be dispensed or the limits of the injection mold manufacturing process. The bottom of the tube may have a sine wave or irregular edge at the end so that the tube cannot become obstructed with the diaphragm or inside of the lid to where fluid flow is impeded. The tube may be designed so that it ends alongside the offset concave diaphragm so that it draws content from the lowest point of the bottle.

The end of a dispenser spout may have a hinged plug to cover the spout to prevent leakage and drying of the content, which may happen if the orifice spout sat open for some period of time. The plug may be placed inside the end orifice similar to putting a stopper on a wine bottle to seal it. The hinged plug may be part of the mold when composite material is used, or if the bottle is glass, a detachably attachable snap-on hinged plug may be used.

In summary, The invention embodiments are novel in the combination of components such as the shape of the bottle, the smoothness of the inside of the bottle where the content is contained, bottle opacity, the way the bottle is held to best dispense the content, the key use of more than one threaded opening used at the top and bottom of the bottle as multiple methods to dispense the content, the use of an air pump, the use of a one-way valve (vent with flap) for equalizing pressure inside the bottle, the use of a novel tube that runs from the bottom of the bottle to push the fluid content up to the dispenser, the use of a centered or offset concave diaphragm to control the dispensing of content, the type of legs or base on which the bottle stands when not in use, the use of a plug at the dispenser to prevent content leakage or drying from exposure, and how the combination of these components features impart the specific method of use for the given embodiment. The method of use to achieve total-use are the multiple openings and the manifold physical features described herein that are necessary to facilitate the flow of content to the bottom for total dispensing. The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
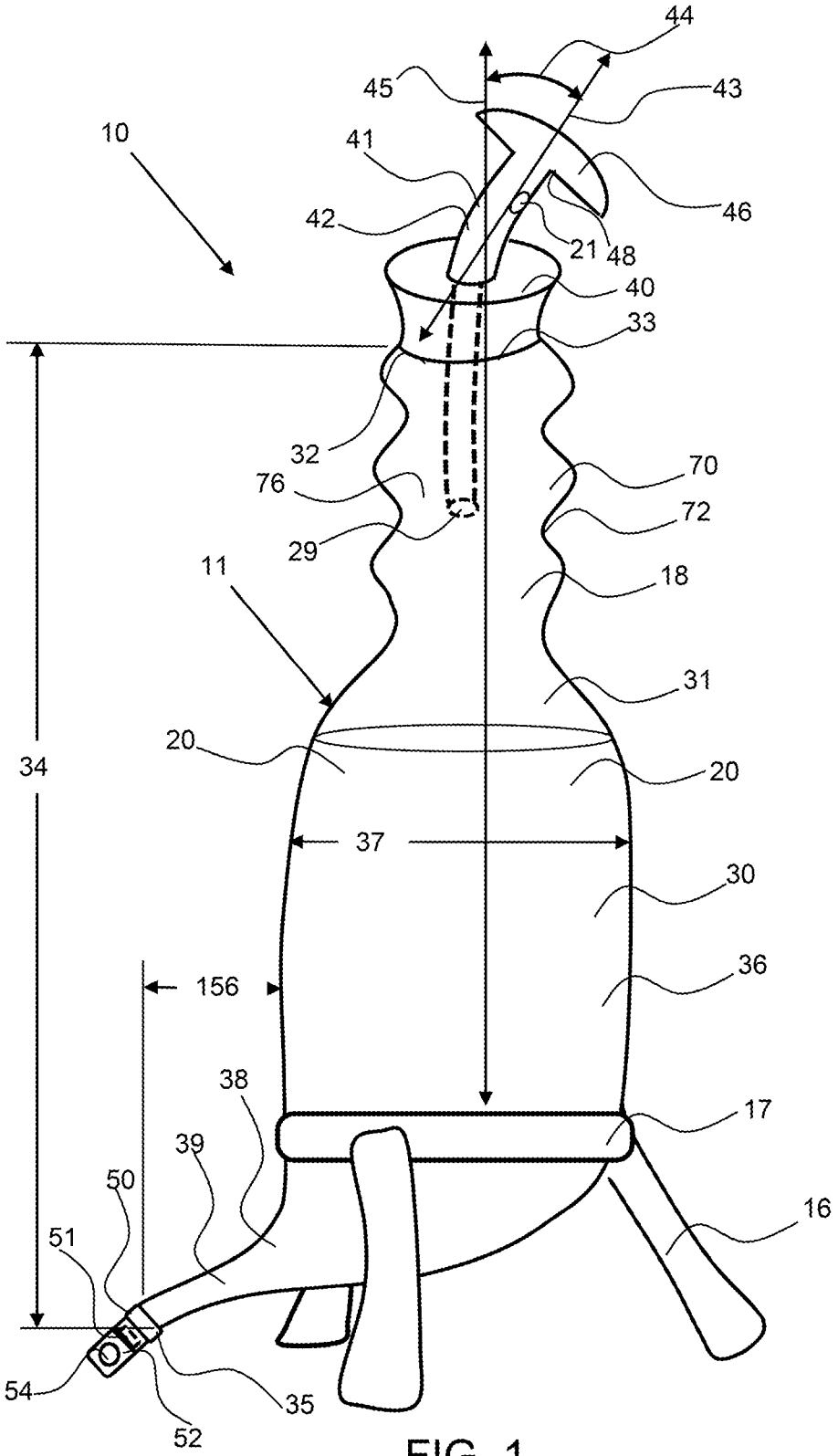
FIG. 1 shows a perspective view of an exemplary total-use dispenser having a rigid body and a pump configured on the top opening and a bottom outlet with an outlet cover.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

A pump is shown in the figures and the pump may be an inline piston air pump. It is to be understood that the pump may include a piston, piston rod, cylinder, a spring, and/or one-way air valves; therefore, these components are not depicted or labeled in the figures. The external components are depicted and labeled however.

As shown in FIG. 1, an exemplary total-use dispenser 10 includes a rigid dispenser 11 with a pump 41 configured on the top opening 32 and a bottom outlet 50 configured on the end of the tapering portion 38 and outlet extension 39, with an outlet cover 52. The total-use dispenser has a rigid body 30 forming an enclosure 31 with a geometry to enable the fluid product 20 contained with the enclosure 31 to flow out of the bottom outlet 50 through a bottom spout 51 when the pump 41 is pumped to produce air pressure in the head space 18 above the fluid. The body 30 forms a rigid enclosure for the fluid product and has a retainer portion 36 that has a cross-sectional area that is larger than the tapering portion 38. The retainer portion of the body may be cylindrical in shape having a diameter 37. The tapering portion has a tapering cross-section area toward the bottom outlet and is configured between the retainer portion and the bottom outlet 50. The body may also have an outlet extension 39 that is part of the tapering portion or extends from tapering portion to the bottom outlet 50. The bottom outlet has an outlet cover 52 with a bottom outlet plug 54 that fits into the bottom spout 51 wherein the fluid product 20 is dispensed. The tapering portion and outlet extension may extend horizontally from the retainer portion an offset distance 156. The offset distance may enable a user to more easily access the dispensing fluid from the outlet when the total-use dispenser 10 is resting on a horizontal surface, such as a counter. The total-use dispenser may comprise a plurality of legs 16 that extend out from the body to enable the total-use dispenser to be free standing on a horizontal surface. The legs may be coupled to a detachable stand 17 that enables the total-use dispenser to be detached and held in a person's hands for dispensing. The body of the total-use dispenser 10 has a height 34 from the top 33, or top opening 32, to the bottom 35 of the body or bottom outlet 50. The bottom outlet 50 may be lowest part of the body 30 and form the bottom of the body.

The pump 41 is configured in the top closure 40 and extends through the top opening 32 and comprises a pump stem 42 that extends from an insert end that is configured inside of the enclosure 31 to an extended end 48 where the pump handle 46 is coupled. The pump stem has a pump valve inlet to allow air into the pump to equalize the pressure. The pump stem extends along a stem axis 43 that is at a stem offset angle 44 from a vertical axis 45. The vertical axis is along the longitudinal axis of the bottle from the bottom to the top. This enables a person to operate the pump more easily with their thumb when holding the body in their hand. The pump stem extends down into the body at the pump outlet 29 where air is pumped into the body to dispense the product. The body may have a grip portion 70 comprising a plurality of indentations 72 configured to receive a person's fingers along the neck 76 of the body. The neck of the body may also be smaller in cross-sectional area than the retainer portion. This reduced cross-section may facilitate gripping the grip portion while pumping the fluid from the bottom outlet via the pump.

Figure 2:
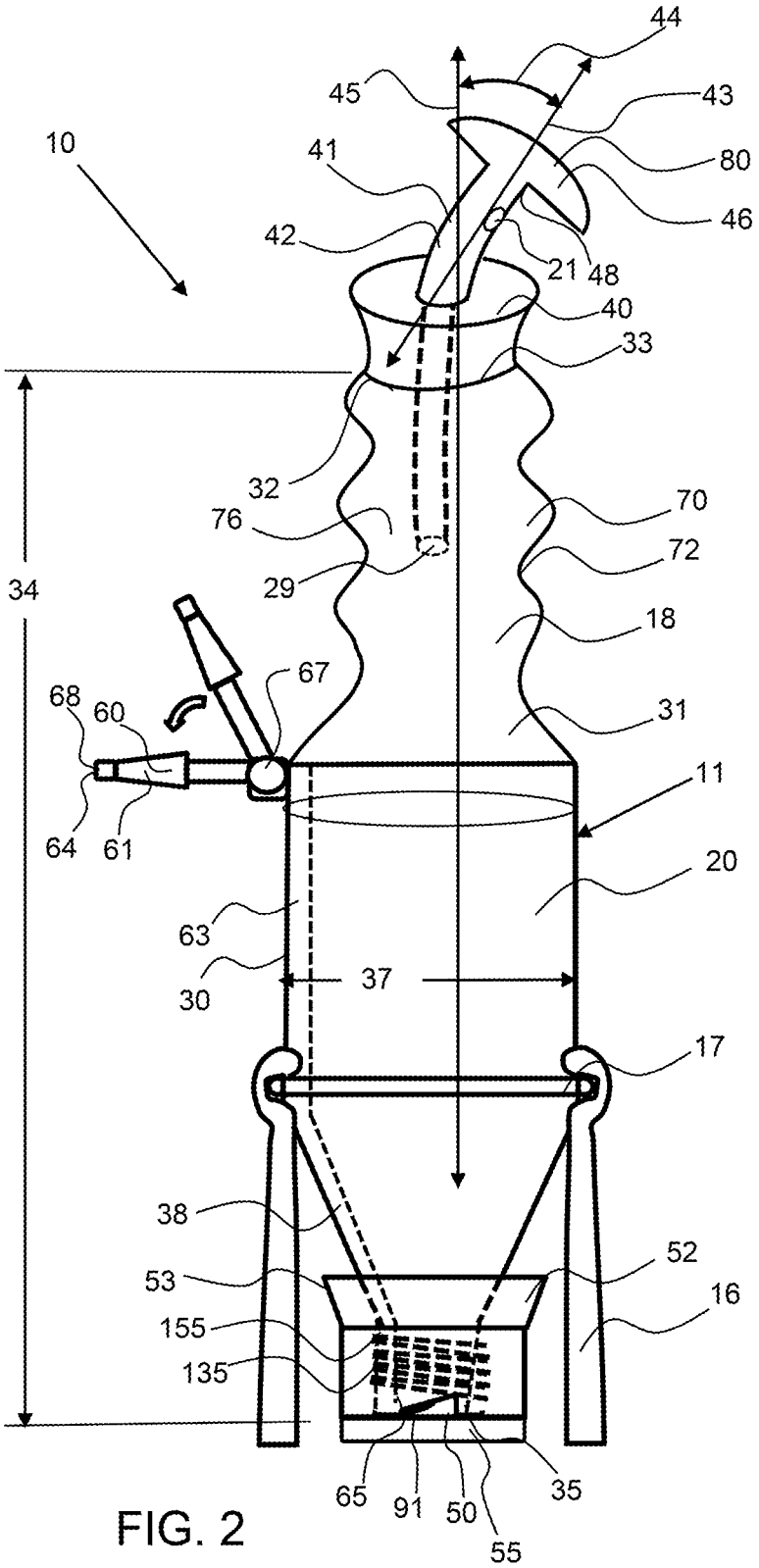
FIG. 2 shows a side view of an exemplary total-use dispenser having a rigid body and a dispenser pump configured on the top opening and a spout outlet extending from the side of the body of the dispenser for dispensing the fluid product therefrom; a spout conduit extends down to the bottom of the enclosure.
Figure 11:
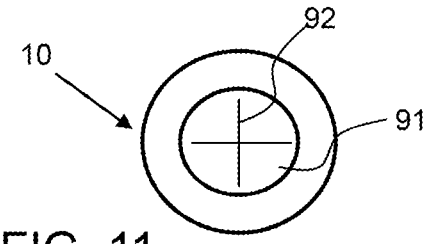
FIG. 11 shows a top view of an exemplary diaphragm having diaphragm slits to allow the resilient diaphragm to open and dispense the fluid product.
Figure 12:
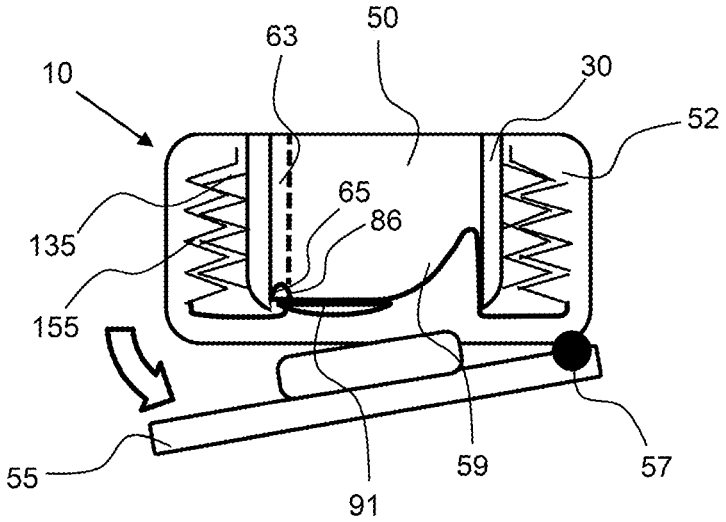
FIG. 12 shows a cross sectional view of a bottom outlet cover coupled to the bottom outlet of the body and wherein the bottom outlet cover has a diaphragm coupled to an angled fluid deflector with the spout conduit extending into the bottom outlet cover.

As shown in FIG. 2, an exemplary total-use dispenser 10 has a rigid dispenser 11, and dispenser pump 40, as shown and described in FIG. 1, configured over the top opening 32, and a spout 60 extending from the side of the body of the enclosure. The exemplary spout has a stop-cock 67 that is operated by rotating the spout up or down. The spout outlet 64 may have a spout conduit outlet 64 with a spout outlet cover 68 to prevent fluid product from drying out between use. A rotatable spout valve 61 is coupled to the end of the spout and can be rotated to close the spout or open the spout. As described herein, there may be two or more dispensing options, such as flow and spray. The spout is coupled with a spout conduit 63 that extends from the spout down to the bottom of the body 30. The spout inlet 65 to the spout conduit may be configured above a diaphragm 91 in the bottom outlet cover 52. In this way, almost all of the fluid product 20 can be drawn up into the fluid conduit. The bottom outlet cover may be as shown in FIG. 12, wherein the bottom outlet cover has an angled fluid deflector that causes the fluid product to flow down to the lower end of the angled fluid deflector for collection into the spout conduit. Also, note that the bottom outlet cover or the body may comprise a diaphragm 91 that allows the fluid product to be dispensed out of the bottom outlet 35 of the body or the bottom outlet 50 of the bottom outlet cover. The bottom outlet cover 52 may have a bottom cap 55 that is configured to open for dispensing the fluid product through the bottom outlet cover, also shown in FIGS. 11 and 12. Also note that the bottom outlet cover may have bottom outlet cover threads 155 that enable the bottom outlet cover to be removed from the body, such as by unthreading from the bottom threads 135 on the body 30 to enable use of the very last bit of the fluid product and/or for cleaning the dispenser.

Figure 3:
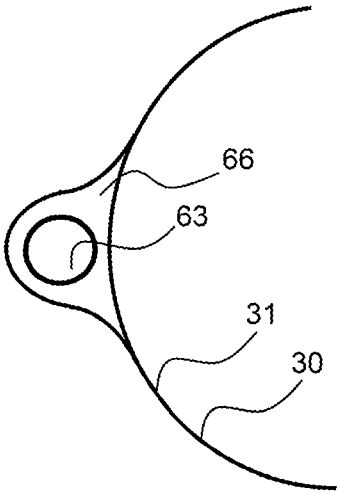
FIG. 3 shows a top partial cross-sectional view of an exemplary body and the spout conduit configured along the outside surface of the body.

As shown in FIG. 3, the spout conduit extends along an outside surface of the body 30 or enclosure 31 and has a spout conduit wall 66 that forms smoothed curved transitions with the outside wall of the body. The conduit diameter may be determined by the viscosity of the fluid content. This geometry may be more conducive for manufacturing, such as by injection molding.

Figure 4:
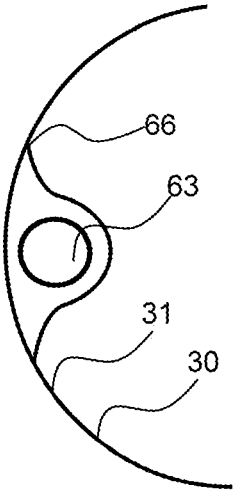
FIG. 4 shows a top partial cross-sectional view of an exemplary body and the spout conduit configured along the inside surface of the body.

As shown in FIG. 4, the spout conduit extends along an inside surface of the body 30 or enclosure 31 and has a spout conduit wall 66 that forms smoothed curved transitions with the wall of the body to prevent fluid product from collecting between the body and the spout conduit. This geometry may promote the fluid product to flow down to the bottom for collection.

Figure 5:
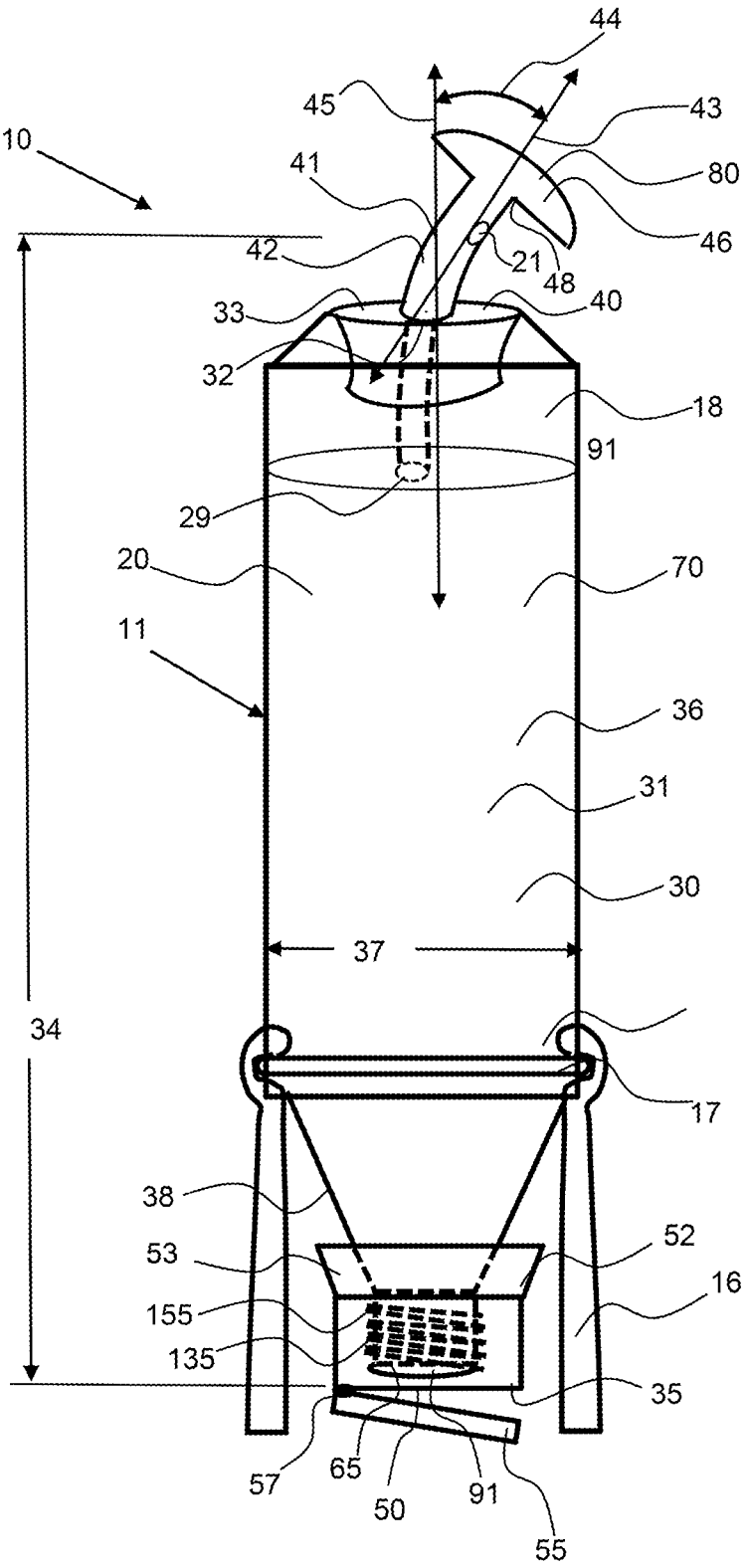
FIG. 5 shows a side view of an exemplary total-use dispenser having a rigid body and a pump configured on the top opening and a bottom outlet with an outlet cover that forms a product cup.

As shown in FIG. 5, an exemplary total-use dispenser 10 has a rigid dispenser 11 with a pump 41 on a top closure 40 configured over the top opening 32. There is a bottom outlet 50 with an outlet cover 52 that forms a product cup 53. The pump 41 is configured in the top opening 32 and comprises a curved pump stem 42 that extends from an insert end that is configured inside of the enclosure 31 to an extended end 48 where the pump handle 46 is coupled. There is an inlet air valve 21, such as a one-way valve, on the pump stem 42 under the pump handle 46. The pump stem extends along a stem axis 43 that is at a stem offset angle 44 from a vertical axis 45. This enables a person to operate the pump more easily when holding the body. The bottom outlet cover may have a bottom cap 55 that is configured to open for dispensing the fluid product through the bottom outlet cover. The bottom cap 55 may have a hinge 57 and the bottom cap may rotate about the hinge. A diaphragm 91 may be configured over the bottom opening of the rigid body 30 and be coupled with the bottom outlet cover. The diaphragm may be as shown in FIG. 11, with a plurality of slits 92 to allow the diaphragm to open to dispense the fluid product 20. Also note that the bottom outlet cover may be removed from the body, such as by the bottom threads 135 to enable use of the very last bit of the fluid product and/or for cleaning the dispenser.

Figure 6:
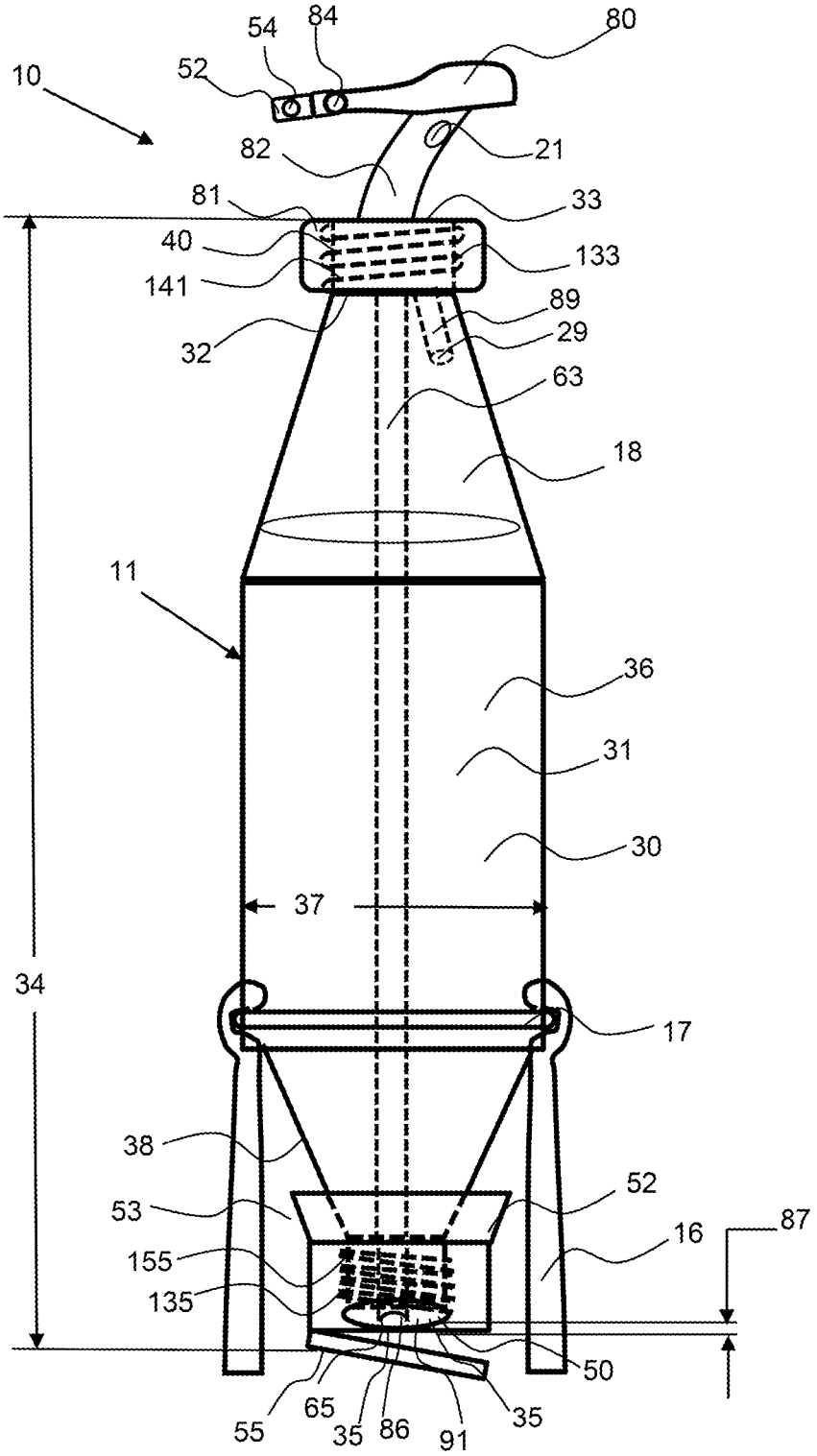
FIG. 6 shows a side view of an exemplary total-use dispenser having a rigid body and a dispenser pump configured on the top opening and a bottom outlet with an outlet cover that forms a product cup; the pump fluid conduit extends down to the product cup.

As shown in FIG. 6, the exemplary total-use dispenser 10 utilizes a rigid dispenser 11 with a dispenser pump 80 that forms the top cap 81 over the top opening of the body 30. The pump stem 82 is angled to provide better ergonomics during use when the user's thumb depresses the pump 80. The dispenser pump has a spout conduit 63, a type of spout conduit that is configured in the top closure, and extends down through the body and down through the tapering portion 38 to a position proximal to the bottom outlet 35 of the body having a bottom outlet cover 52 thereon. The spout inlet 65 for the fluid product may have a concave in shape around the end edge to ensure that fluid product 20 from within the body can enter into the spout conduit 63 even when configured with a small offset gap 87 with the bottom cap 55. As described herein, the small offset gap may be no more than 10 mm, or no more than 5 mm, or even no more than 3 mm and any range between and including the gap distances listed. The dispenser pump forces air from outside of the body 30 into the body through the pump air conduit 89. The increased air pressure inside the body forces the fluid product up through the spout conduit 63 for dispensing through the pump outlet 84. The bottom outlet cover 52 may be detachable by the threads 135, female threads, to form a product cup 53 that has a hinged bottom cap 55 that can be opened and closed. The bottom 35 of the body 30 may have male threads 135 for coupling with the bottom outlet cover threads 155 of the bottom outlet cover. A diaphragm 91 may be configured to allow product to be dispensed from the bottom outlet 50 when the bottom cap 55 is opened. This exemplary total-use dispenser 10 has two methods of dispensing product, one through the top pump outlet 84 and two, through the diaphragm 91 and bottom outlet 50. The cover 52 may need to be closed when dispensing product from through the bottom outlet. The inlet air valve 21 may allow air into the interior of the body to allow product to dispense through the bottom outlet 50. Depressing the top pump dispenses product by the shortening of the pump stem 82. The dispenser pump 80 is coupled to the enclosure 31 or body 30, by a top closure 40, or top cap 81 configured over the top 33 of the body 30. The top cap 81 has threads 141, female threads, configured to thread onto threads 133 configured on the top 33 of the body 30 or enclosure 31.

Figure 7:
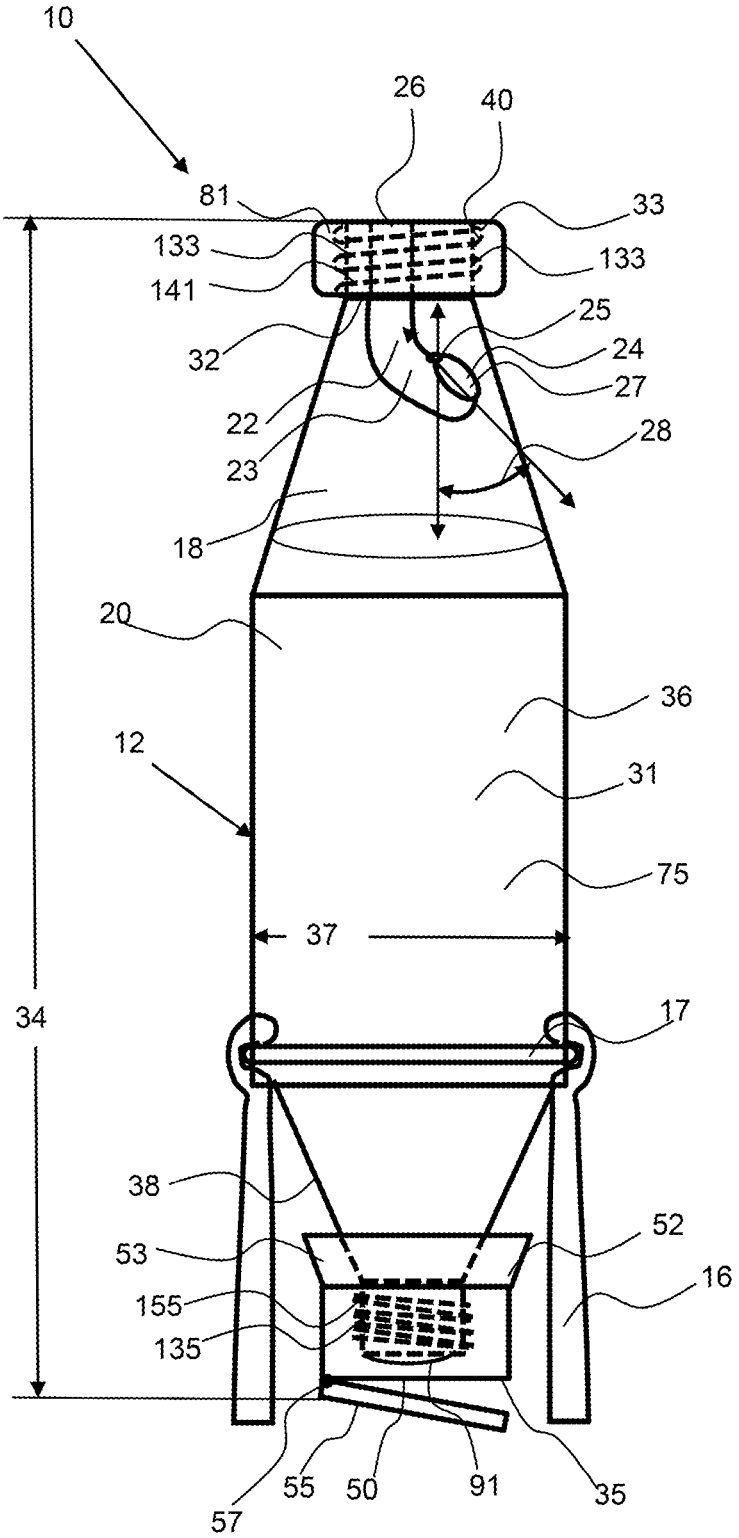
FIG. 7 shows a side view of an exemplary total-use dispenser that is a deformable and resilient squeeze bottle having a vent configured with the top closure and a diaphragm configured in the bottom outlet cover.

Referring now to FIGS. 7, an exemplary total-use dispenser 10 utilizes a squeezable dispenser 12 that has a detachably attachable screw-on top closure 40 that has an airflow vent inlet 26 configured on the top opening 32 and a bottom outlet 50 with an outlet cover 52 that forms a product cup 53 for removal and use of the fluid product therein. The fluid product 20, such as a liquid, gel, lotion or cream is configured within the body, a squeezable dispenser 12, and squeezing the resilient-deformable body 75, or bottle, forces the fluid product out through the bottom outlet 50 through a diaphragm 91 that is part of the bottom outlet cover 52. The bottom outlet cap 55 opens at a hinge 57 to allow product to be dispensed and is closed to prevent further dispensing of product. Once the body 30 is squeezed to dispense product, the user releases the pressure on the body, which allows the resilient-deformable body to go back to its original shape because air flows through the vent 26 and one-way valve assembly 22 to equalize the pressure inside the body. The one-way valve assembly 22 has a vent cover coupled to the vent conduit by a vent hinge 25. The vent outlet 27 allows air to be drawn from outside the dispenser through the airflow vent inlet 26, through the vent conduit 23 and out the vent outlet 27 into the interior of the deformable body 75. The vent cover 24 is configured at a vent cover offset angle 28 to prevent fluid product 20 from clogging the vent.

Figure 8:
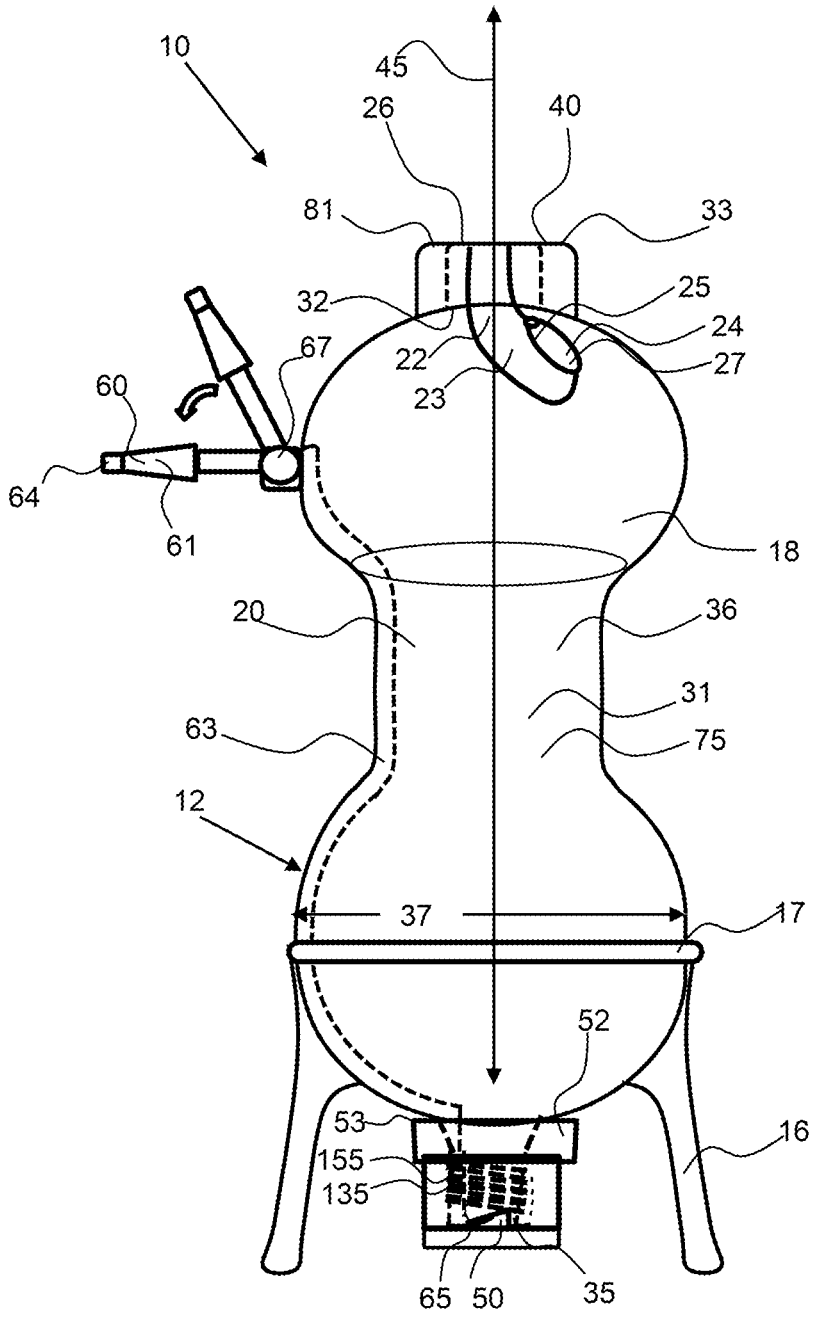
FIG. 8 shows a side view of an exemplary total-use dispenser that deformable and resilient squeeze bottle having a spout coupled with a spout conduit that extends down to the bottom outlet cover.
Figure 9:
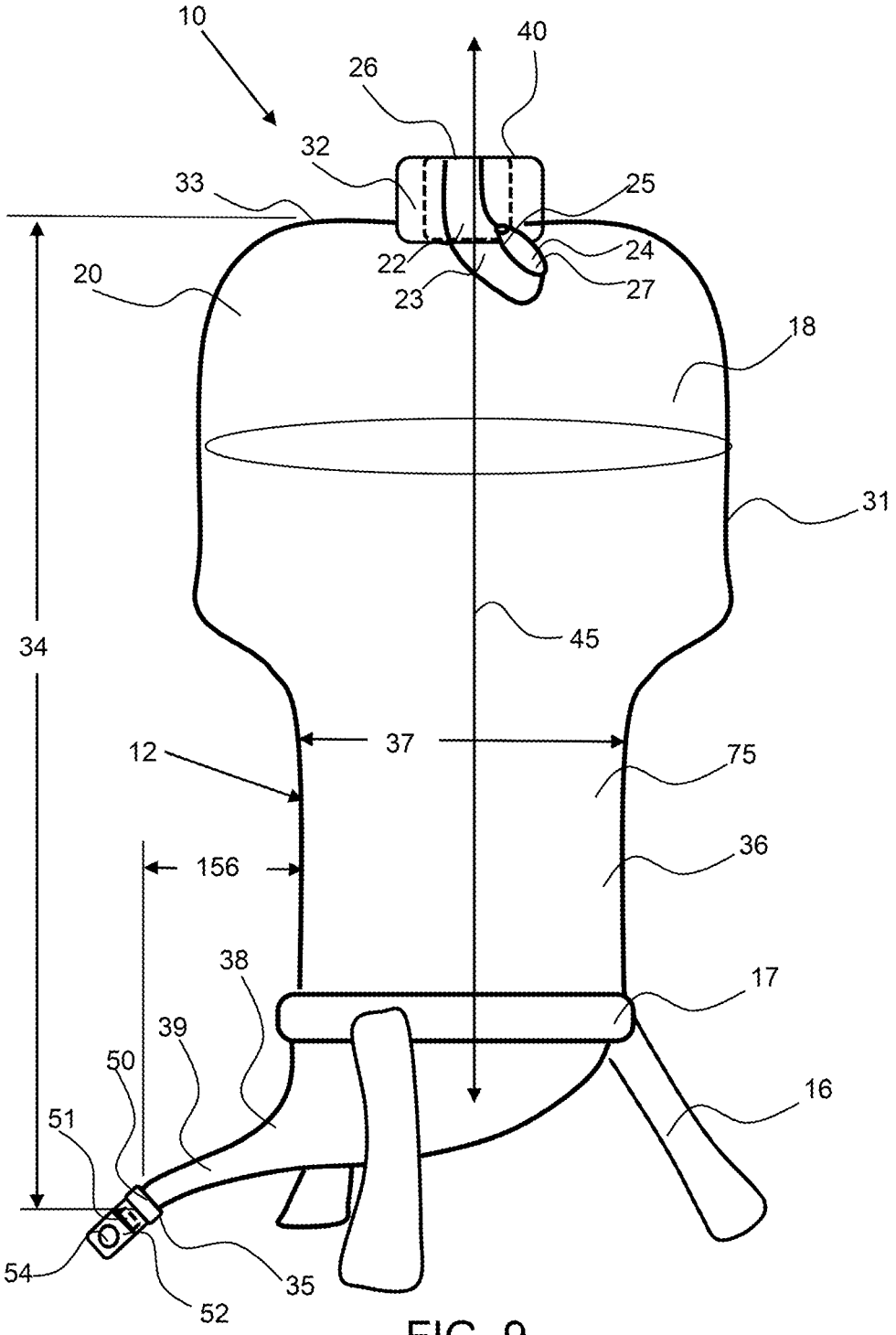
FIG. 9 shows a side view of an exemplary total-use dispenser that is a deformable and resilient squeeze bottle having a bottom spout coupled to a bottom outlet extension and an outlet plug configured to seal the bottom spout.

As shown in FIGS. 7, 8 and 9, an exemplary vent assembly 22 may be configured with a squeezable dispenser 12. The exemplary vent assembly has a vent opening 26 and vent conduit 23 that extends down into the body 30, and a vent cover 24 that is configured at a vent cover offset angle 28 when it may be closed by gravity. The vent cover may be configured over the vent outlet 27 by a vent hinge 25. When the body is squeezed, the vent remains closed due to gravity to prevent air from coming into the body from outside. When the user releases the pressure on the body, air is then drawn in through the vent inlet 26, through the vent conduit 23 and into the interior of the body through the hinged vent cover 24 at the vent outlet 25. The vent assembly 22 then acts as a one-way valve to let air into the body any time there is a negative air pressure within the body to equalize the pressure with the outside.

As shown in FIG. 7, the total-use dispenser has a bottom outlet cover 52 having a diaphragm 91 to allow the fluid product 20 to be dispensed therethrough. The bottom cap 55 may be opened by the bottom cap hinge 57 and the body may be squeezed to dispense the fluid product. The bottom outlet cover may be coupled to the body by threads 135. The body may have male threads and the bottom outlet cover may have corresponding female threads.

As shown in FIG. 8, an exemplary total-use dispenser 10 is a squeeze bottle having a spout 60 coupled with spout conduit 63 that extends down to the bottom outlet cover 52. The body 30 may be squeezed to dispense the product through the spout or through the bottom outlet 50. The bottom outlet cover may be configured like that shown in FIG. 12, wherein the spout conduit inlet 65 is configured over the angled fluid deflector 59 and bottom diaphragm 91. Also, as shown in FIG. 8, the total-use dispenser has a vent assembly 22 as described, herein.

As shown in FIG. 9, an exemplary total-use dispenser 10 is a squeeze bottle having a shape that facilitates squeezing the body for dispensing the fluid product at the smaller diameter 37. The top portion of the body is larger in cross section diameter along a vertical axis 45 than a lower portion. The lower portion may be easily held and squeezed and the larger upper portion may prevent the body from slipping through the person's hand during use. The total-use dispenser 10 has a bottom spout 51 coupled to a bottom outlet extension 39 and having a bottom outlet plug 54 configured to seal the bottom spout. Also, as shown in FIG. 9, the total-use dispenser has a vent assembly 22 as described, herein. The bottom outlet 50 is configured a lateral offset distance 156 from the body 30 to facilitate dispensing product from the body.

Figure 10:
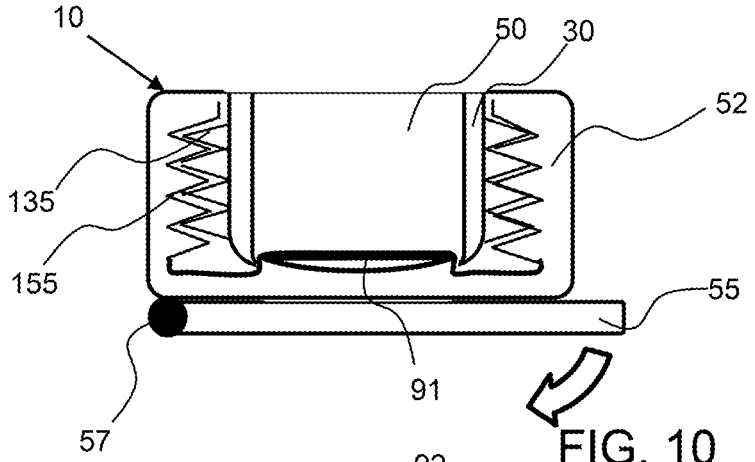
FIG. 10 shows a cross sectional view of a bottom outlet cover coupled to the bottom outlet of the body and wherein the bottom outlet cover has a diaphragm and a bottom cap.

As shown in FIG. 10, an exemplary bottom outlet cover 52 is coupled to the bottom outlet 50 of the body 30. The bottom outlet cover has a diaphragm 91 and a bottom cap 55 that is coupled to and rotates about the bottom outlet cover by a hinge 57. The body has bottom threads 135 that engage with the bottom outlet cover threads 155 of the bottom outlet cover to allow the bottom outlet cover to be removed and attached to the body. To restate, all threaded top and bottom closures may have the bottle threads on the outside of the body 30 so that the inside of the bottle outlets 50 and top openings 32 with or without pumps may have smooth walls inside the body. This is important for ensuring the near totality of the fluid products easily flow through the outlets and the bottles are easier to clean for reuse.

As shown in FIG. 11, an exemplary diaphragm 91 has diaphragm slits 92 to allow the resilient diaphragm to open and dispense the fluid product. The viscosity of the fluid product may determine the slit size, diaphragm thickness (determines the amount of resistance to fluid flow), and whether a diaphragm is required to prevent product leakage when the cap 55 is opened. In general, a diaphragm will be used as a component of the bottom outlet cover 52 because it may better control fluid product flow based on pump pressure in rigid bottles and pressure from squeezing in deformable bottles.

As shown in FIG. 12, an exemplary bottom outlet cover 52 is coupled to the bottom outlet 50 of the body 30. The bottom outlet cover has a diaphragm 91 coupled to an angled fluid deflector 59 with the spout conduit 30 extends down into the bottom outlet cover to the lower edge of the angled fluid deflector. The surface of the angled fluid deflector is curved to provide a substantially flat area for the diaphragm 91. This configuration enables almost all of the fluid product to be drawn up into the spout fluid conduit inlet 65. As shown, the spout fluid conduit inlet has a concave shape inlet 86. The body has bottom threads 135 that engage with the bottom outlet cover threads 155 of the bottom outlet cover to allow the bottom outlet cover to be removed and attached to the body. The bottom outlet cover 52 has a bottom cap 55 that is coupled by a hinge 57 with the bottom outlet cover. Therefore, fluid product may be drawn up into the spout conduit 63 or dispensed through the diaphragm and out the bottom outlet 50 of the body.

The total-use dispenser as shown in FIGS. 1 to 9 may have legs 16 to support the body 30 in an upright position and these legs may form a stand 17 that is detachably attachable to the body. The legs and/or stand may also be attached to the body whereby they cannot be removed. The legs or stand and body may be a monolith, formed from a single piece of material, such as a molded product.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A total-use dispenser for dispensing a fluid product therefrom, said total-use dispenser comprising:

a) a body forming an enclosure and comprising:
  i) a top opening having male threads configured around said top opening;
  ii) a bottom outlet;
  iii) a retainer portion; and
  iv) a tapering portion configured between said retainer portion and said bottom outlet that tapers in cross sectional area toward the bottom outlet;

b) a top closure; and c) a pump configured in the top closure that pumps air into the body to dispense said fluid product; and d) a spout conduit having a spout conduit inlet configured in the fluid product and configured to direct a flow of fluid product therethrough to a spout outlet to dispense said fluid product from said spout outlet;

e) a bottom outlet cover comprising:
  a bottom cap that is configured to open and close the bottom outlet; and an angled fluid deflector extending over the bottom outlet that angles from an upper side to a lower side;

wherein the spout conduit inlet is configured in the bottom outlet cover; and wherein the total-use dispenser is configured to dispense at least 90% of the fluid product therefrom.

2. The total-use dispenser of claim 1, further comprising an outlet extension that extends horizontally away from the retainer portion, wherein the bottom outlet is extended horizontally an offset distance from the body of the retainer portion.

3. The total-use dispenser of claim 2, further comprising a bottom outlet cover and wherein the bottom outlet cover is a bottom outlet plug configured to bottom outlet.

4. The total-use dispenser of claim 1, further comprising a bottom outlet cover and wherein the bottom outlet cover comprises a bottom cap that is configured to open and close the bottom outlet.

5. The total-use dispenser of claim 1, further comprising a product cup configured to extend over the bottom outlet, wherein the product cup is detachably attachable to the body.

6. The total-use dispenser of claim 5, wherein the product cup has female threads and wherein the body has bottom outlet threads that are male threads for engagement with the product cup female threads.

7. The total-use dispenser of claim 5, wherein the bottom outlet cover further comprises a diaphragm configured on the lower side of the angled fluid deflector.

8. The total-use dispenser of claim 7, wherein the diaphragm is an elastomeric material having a plurality of slits to allow the diaphragm to open to dispense the fluid product when the fluid product is pressurized and then close after dispensing the fluid product.

9. The total-use dispenser of claim 1, further comprising an inlet air valve that is a one-way valve configured to allow air to flow into the body to equalize air pressure when vacuum is formed in the body.

10. The total-use dispenser of claim 1, wherein the pump further comprises a fluid conduit that extends down through the enclosure to a fluid conduit inlet configured proximal to the bottom outlet.

11. The total-use dispenser of claim 10, further comprising a product cup configured to extend over the bottom outlet, wherein the product cup is detachably attachable to the body.

12. The total-use dispenser of claim 11, wherein the fluid conduit extends down through the body and into the product cup.

13. The total-use dispenser of claim 1, wherein the spout conduit extends through the top cover to said spout outlet that is coupled with the stem.

14. The total-use dispenser of claim 1, wherein the spout conduit extends along the outside wall of the body.

15. The total-use dispenser of claim 1, wherein the body is a resilient-deformable body configured to dispense fluid product by squeezing and deforming the body to increase pressure in a head space over the fluid product.

* * * * *